US005354011A

United States Patent [19]

Rozon

[11] Patent Number: 5,354,011

[45] Date of Patent: Oct. 11, 1994

[54] TAKE-UP REEL FOR WINDOW BLIND CORDS

[75] Inventor: David P. Rozon, Russel, Canada

[73] Assignee: 2844788 Canada Ltée, Quebec, Canada

[21] Appl. No.: 22,891

[22] Filed: Feb. 26, 1993

[51] Int. Cl.[5] ..... B65H 75/48

[52] U.S. Cl. ..... 242/402; 242/376; 242/378.1

[58] Field of Search ..... 242/100.1, 107.1, 107.11, 242/107.12, 107.13, 107.14, 107.15, 107.6; 160/170, 171

[56] References Cited

U.S. PATENT DOCUMENTS

| | | | |
|---|---|---|---|
| 2,167,571 | 7/1939 | Hellman | 242/107.1 |
| 2,211,561 | 8/1940 | Flannelly | 242/107.1 |
| 4,053,118 | 10/1977 | Aikins | 242/107.11 |
| 4,271,893 | 6/1981 | McCluskey | 242/107.13 |
| 4,417,703 | 11/1983 | Weinhold | 242/107.12 |
| 4,646,987 | 3/1987 | Peterson | 242/107.11 |
| 4,726,536 | 2/1988 | Lerner et al. | 242/100.1 |
| 4,901,938 | 2/1990 | Cantley et al. | 242/107.6 X |
| 4,989,805 | 2/1991 | Burke | 242/107.1 |
| 5,094,396 | 3/1992 | Burke | 242/107.1 |

*Primary Examiner*—Daniel P. Stodola
*Assistant Examiner*—John P. Darling
*Attorney, Agent, or Firm*—Adrian Zahl

[57] ABSTRACT

A take up reel for window blind cords, comprising a rotatably driven spool having a cord attachment member fixedly engaged thereto and spaced apart from a cord receiving surface of the spool. The member is adapted to alternatively slidingly engage a cord positioned within said device, when the device is in an unretracted position, and fixedly engage said cord when said device is in a retracted position. In a further aspect of the invention, a cord retraction device comprising a rotatably driven spool with an attachment member adapted to engage a cord thereto is provided, with the spool being further provided with a retainer rotatably engaged to an end thereof and adapted to retain the cord on a cord-receiving surface of the spool. The retainer is rotatable between first and second positions, wherein in the first position the attachment member is exposed for user access thereto, and in the second position, the cap cooperates with the spool to retain the cord on the cord receiving surface thereof.

6 Claims, 4 Drawing Sheets

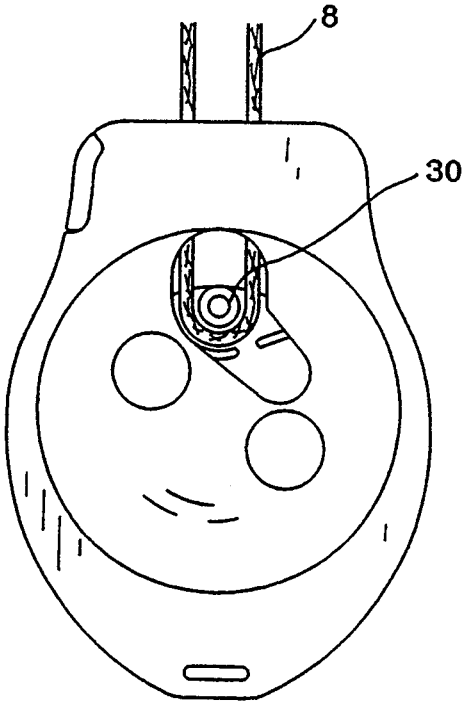
FIG 4
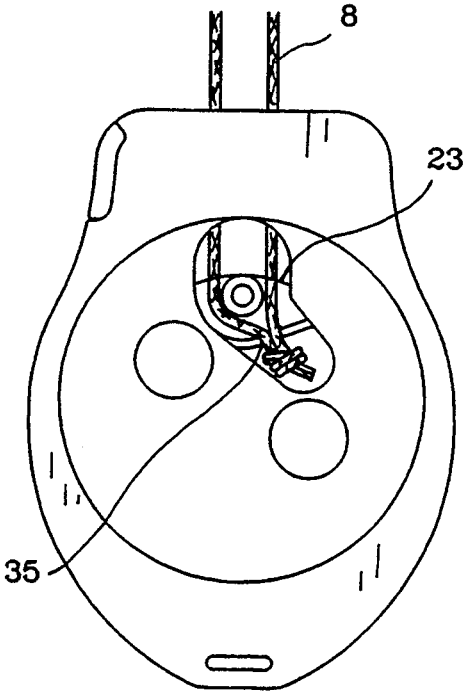
FIG 7
FIG 5
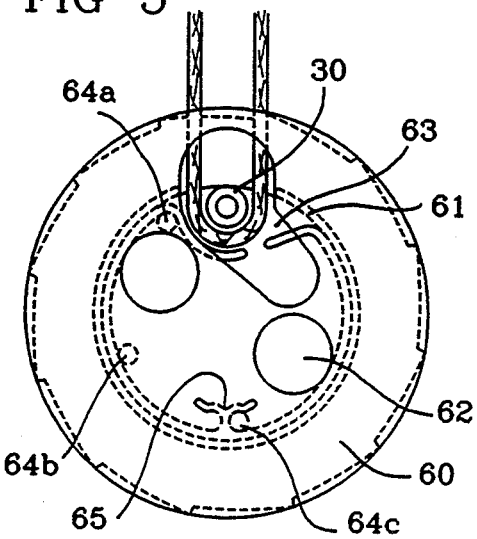
FIG 6
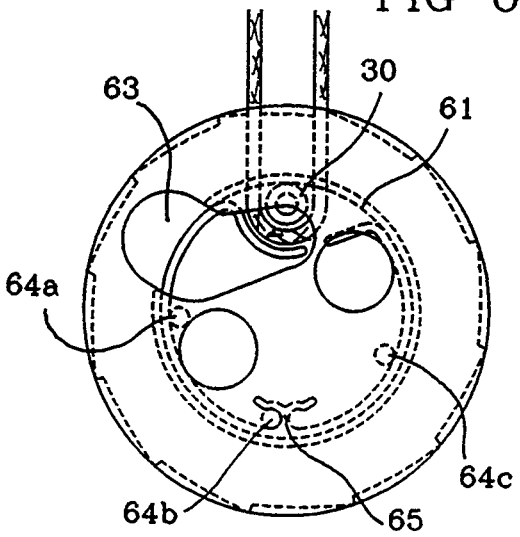

TAKE-UP REEL FOR WINDOW BLIND CORDS

FIELD OF THE INVENTION

The present invention relates to a take-up reel, or retraction device, for the taking up of slack in dangling window blind cords.

BACKGROUND OF THE INVENTION

This application is related to applicant's pending application Ser. No. 07/877,212, entitled "Cord Retraction Device", now U.S. Pat. No. 5,279,473.

Retraction devices for the taking up of slack in free-ended cords, chains and the like (all of which will be collectively referred to herein as "cord") exist for many applications. However, a device capable of use in association with a vertical window blind (i.e., a blind having vertically-oriented slats depending from a head unit) must be capable of retracting a cord loop, since the blind opening cord (as opposed to the slat-rotating means) of a vertical blind typically comprises a long continuous loom, which may be cycled alternately in one direction or the other for the opening or closing of the blind. For safety and aesthetic reasons it is desirable to retract a portion of the cord loop. The device must be capable, in its unretracted position, of allowing the cord to freely pass through the device in order to allow the cord loop to cycle through the blind head. It is desirable to provide a device capable as well of retracting the free-ended cords found in venetian blinds. Further, i% is desirable to provide a device that is capable of easy engagement to a cord, for the convenience of the user.

While many retraction devices exist for the taking up of free-ended cords, these existing devices do not provide an adequate solution to the requirements of window blind cords. For example, the cord retraction device disclosed U.S. Pat. No. 4,271,893 (McClusky) comprises a typical arrangement of a spring-driven spool rotatably engaged within a housing; means are not provided to allow a cord loop to cycle through the device in the unretracted position.

The retraction device described and claimed in the applicant's pending U.S. application Ser. No. 07/877,212 provides a device comprising a rotatably-driven spool within a housing, wherein the spool is provided with attachment means adapted to alternately slidingly and fixedly engage a cord loop, wherein the cord is free to slide through the attachment means when the cord is in the unwound but is fixedly engaged to the spool when retracted. The device also serves as a conventional take-up device for use with the free-ended cords of a venetian blind.

It is desirable that any such device be simple and easy to use, in order to minimize manufacturing costs, provide ease of assembly and use, and be reliable and long lasting. Accordingly, it is desirable that the number and complexity of components of the device be reduced to a minimum. The present invention provides a simpler version of the device described in applicant's said prior invention.

OBJECTS OF THE INVENTION

It is an object of the present invention to provide a cord take-up device adapted for use with the cord loop of a vertical blind. It is a further object of the invention to provide a device capable as well of taking up the free-ended cords of a venetian blind. It is a further object to provide a device capable of simple fabrication, assembly and use.

SUMMARY OF THE INVENTION

The present invention comprises a cord retraction device comprising a rotatably driven spool with attachment means adapted to engage a cord thereto is provided, with the spool being further provided with a retainer rotatably engaged to an end thereof and adapted to retain the cord on a cord-receiving surface of the spool. The retainer is rotatable between first and second positions, wherein in the first position the attachment means is exposed for user access thereto, and in the second position, the retainer cooperates with the spool to retain the cord on the cord receiving surface thereof. The retainer may comprise a disk-shaped cap oriented perpendicular to the longitudinal axis of the spool.

BRIEF DESCRIPTION OF THE DRAWINGS

FIG. 4 is a front elevational view of the device, with the outer cover removed, showing the device with the retainer positioned in the cord installation position and a cord loop installed therein;

FIG. 5 is a front elevational view of a spool assembly, showing the retainer in the use position and a cord loop installed;

FIG. 6 is a front elevational view as in FIG. 5, showing the retainer in the cord installation position;

FIG. 7 is a front elevational view as in FIG. 4, showing two free-ended cords installed therein;

DETAILED DESCRIPTION OF THE PREFERRED EMBODIMENT

Figure 1:
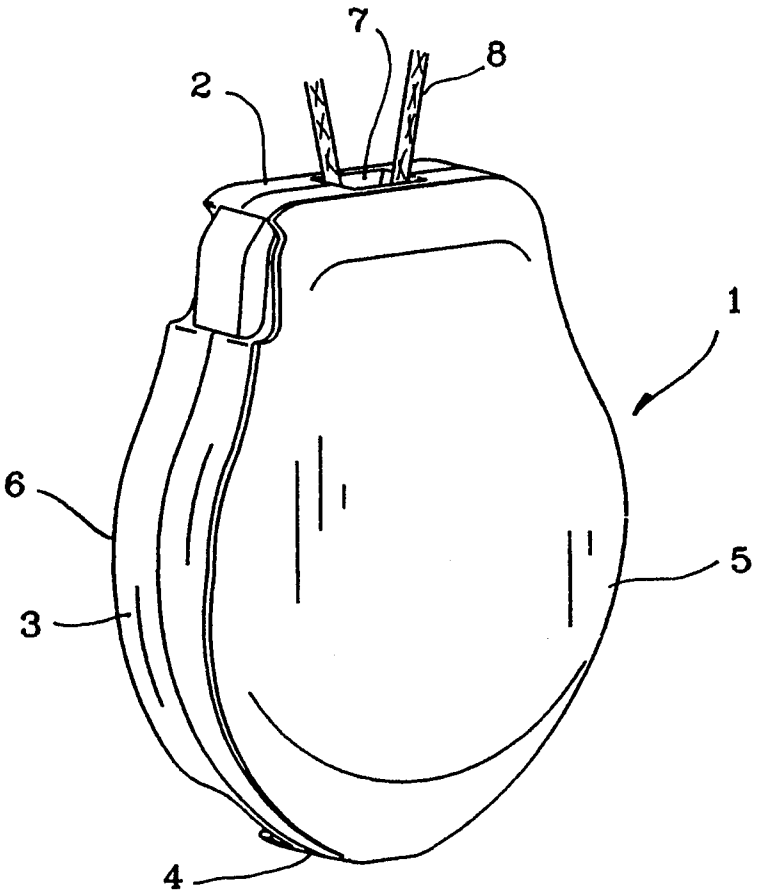
FIG. 1 is a perspective view of the assembled device.

Referring to FIG. 1, the cord retraction device according to the present invention comprises a generally oval housing 1, having a flattened top 2 and front and rear faces 5 and 6, respectively. The directional references used herein refer to the device positioned in the normal position, with the cords extending from the top thereof, and are used for purposes of convenience only; it will be obvious that the device may be used in any orientation. The housing is provided with an aperture 7 extending through the top 2, for the entry and exit of a cord 8 of a window blind. The cord 8 may comprise either a cord loop of a vertical blind, or the two free-ended cords of a venetian blind. It is possible as well, with a venetian blind, to provide blind opening cords that comprise a cord loop. For use with this arrangement, a venetian blind cord loop may be installed in the device in the same manner as the cord loop of a vertical blind. For this use, the device may serve to equalize the lengths of the respective sides of the loop, to prevent slack in one side or the other, as can occur with a pair of free-ended cords engaged to a retraction device.

Figure 2:
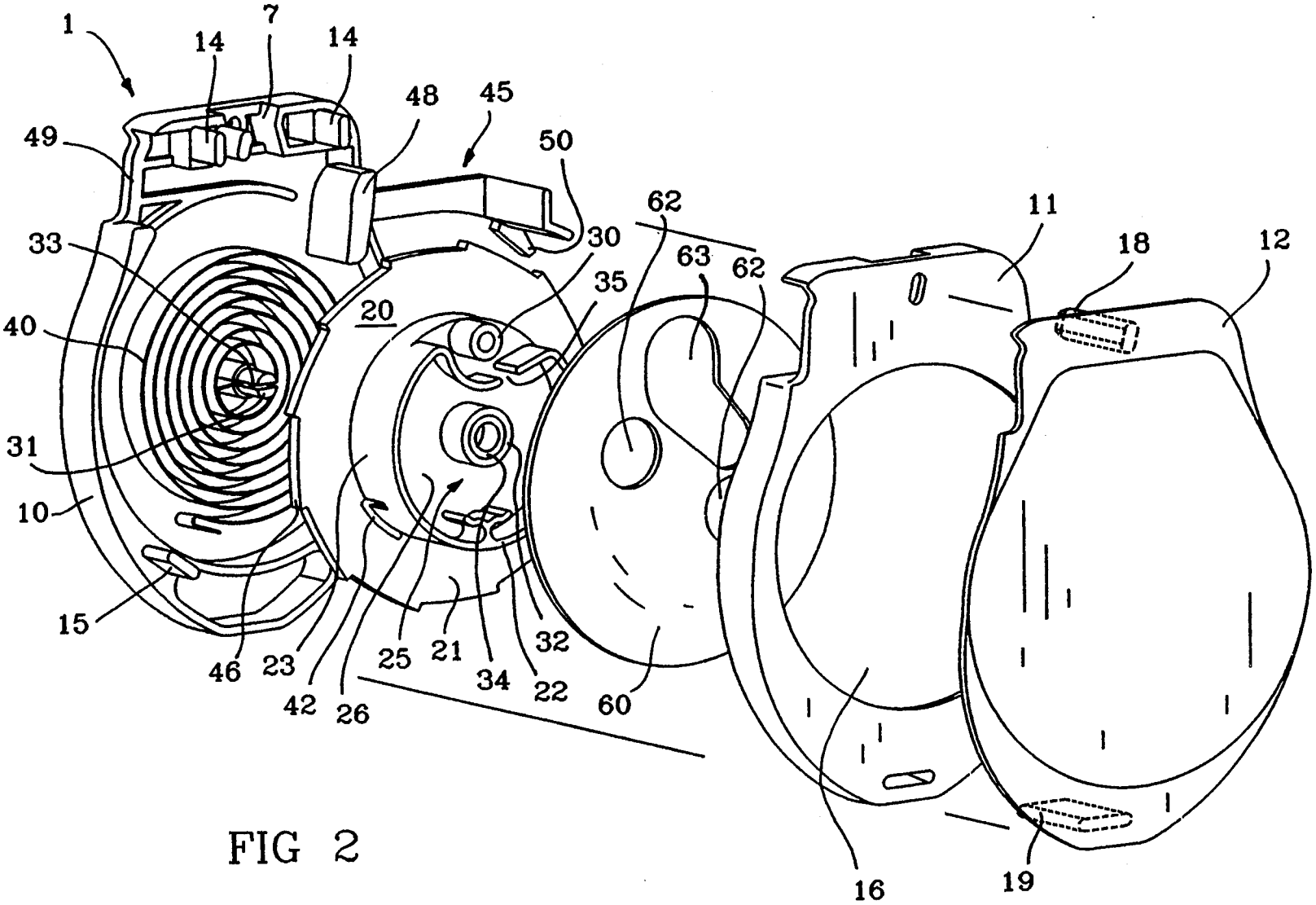
FIG. 2 is an exploded view, in perspective, of the device.

Turning to FIG. 2, the housing 1 is comprised of a body 10, an inner cover 11 and an outer cover 12. The inner cover is fastened to the body by upper and lower pins 14, 15 extending from the body 10, releasably engageable with corresponding apertures within the inner cover. The inner cover 11 is provided with a central opening 16, to provide access to the interior of the housing. A cord divider pin 18, interposed between the entering and exiting portions of the cord, extends from the outer cover 12, through the inner cover, to the body 10 across the aperture 7. The divider pin serves the dual functions of retaining the outer cover to the case, and providing a means for preventing the cord from becoming twisted upon itself as it enters and exits the housing. The divider pin 18 also serves, along with an engagement member 19 extending from a lower portion of the outer cover, to releasably retain the outer cover to the inner cover.

A spool assembly 20 is rotatably mounted within the housing. The spool assembly comprises a ratchet gear 21, with a generally tubular spool 22 comprising the hub thereof. The rim 23 of the spool 22 provides a cord take-up surface on the exterior thereof. The interior of the spool is divided into interior and exterior compartments 24, 25 by a vertical wall 26 extending across the middle thereof. The interior compartment 24 (shown in FIG. 3) houses a drive spring, described below, and the exterior compartment accommodates a cord engagement means. The cord engagement means comprises a post 30, extending laterally from the wall 26 and positioned within a depressed portion of the rim 23, such that the top of the post is generally flush with the exterior of the rim 23. The spool is rotatably engaged to a spindle 31 extending laterally from the rear wall of the body 10 through a hub 32 extending laterally through the spool assembly. A groove 33 is recessed into the free end of the spindle to accommodate the drive spring, as described below.

The hub 32 is rotatably mounted to the spindle 31 by means of a bushing 34 interposed between the spindle and hub. The bushing 34 prevents the spindle from splaying apart at the groove 33 when the spool assembly is placed under a load, as may occur in use. Any such splaying would tend to cause the spindle to bind within the hub.

In use with a cord loop, as shown in FIGS. 4 through 6, a portion of cord is positioned within the device and extends around the post 30. When thus positioned, in the unretracted position shown in FIGS. 4–6, the cord is free to slide through the device, about the post 30. When in the retracted position, shown in FIG. 8, the cord is fully (or partly) wound up about the spool 22, and is incapable of sliding through the device.

The cord engagement means may also engage the free ends of a pair of venetian blind cords, as shown in FIG. 7. The cord ends are inserted through a slot 35 extending through the depressed portion of the spool rim 23, and the free ends of the cord are knotted to retain the cords within the slot. When used in this fashion, the device functions in generally the same fashion as a conventional cord take-up device. As discussed, the cords of a venetian blind may also be provided in the form of a loop, which may be engaged to the device in the same manner as the cord loop of a vertical blind. When used in this fashion, the device serves to equalize the lengths of the respective sides of the venetian blind cord loop.

Figure 3:
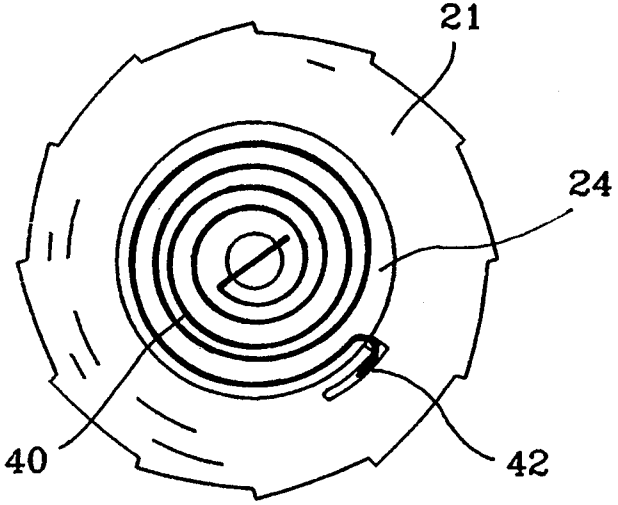
FIG. 3 is a rear elevational view of the spool assembly of the device, with the drive spring positioned therein.

The spool assembly is rotatably driven by a coil drive spring 40, shown in FIGS. 2 and 3, housed within the interior compartment of the spool. An inner end of the spring is engaged within the groove 33, and the outer end thereof is engaged by a slot 42 extending through the spool assembly at the rim 23. The spring is positioned to drive the spool assembly counterclockwise, the winding up of the spring being effected by the clockwise rotation of the spool assembly resulting from the unwinding of the cord from about the spool as the cord is pulled out from the device.

Figure 8:
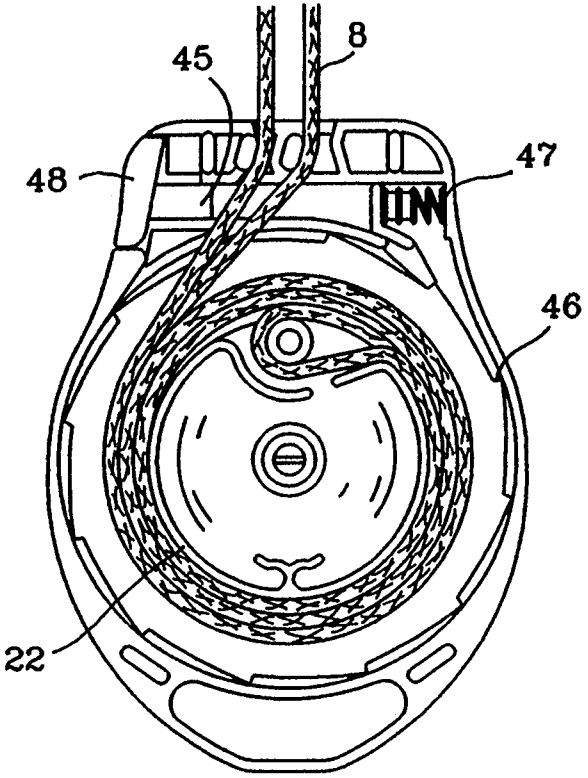
FIG. 8 is a front elevational view, showing a cord loop wound onto the spool assembly.

Referring to FIGS. 2 and 8, a ratchet 45, positioned within the housing 1, releasably engages teeth 46 extending around the perimeter of the gear 21, to prevent counterclockwise rotation (when viewed from the front) of the spool assembly except when released. The spool assembly is free rotate in the clockwise direction, the rotation thereof in this direction being resisted by the action of the drive spring rotationally biasing the spool assembly in the counterclockwise direction. The ratchet 45 is actuated by means of a button 48 extending outwardly from the housing. A spring 47 biases the ratchet laterally, to prevent disengagement of the gear 21 until the button 48 is depressed, which allows the spool assembly to be driven by the drive spring 40 in the counterclockwise direction to retract the cord 8, as shown in FIG. 8.

The spool assembly is capped by a retainer 60, shown in FIG. 2, that serves to retain the cord on the spool assembly and selectively provide user access thereto to enable positioning of the cord about the cord engagement means. The retainer is provided with a rim 61 rotatably engageable to the spool assembly. The end cap 60 is rotatable between an access position, seen in FIG. 5, and a use position, seen in FIG. 6. A pair of openings 62 are provided to facilitate the user's grip on the end cap, and a generally elbow-shaped opening 63 provides user access to the cord engagement means when the end cap is in the access position. In the use position, seen in FIG. 6, the cord engagement means is partly covered by the end cap, and the cord is prevented thereby from sliding off the engagement means.

Referring to FIGS. 5 and 6, the end cap is provided with first, second and third posts 64(*a*), (*b*) and (*c*) extending inwardly therefrom, towards the interior of the case. The second and third posts 64(*b*) and (*c*) are adapted to releasably engage a stop member 65 on the spool assembly, to limit the rotationary movement of the end cap and provide the two position movement thereof. The stop member 65 is shaped to engage the posts with a snap-lock type of action. The third post 64(*c*) is adapted to cooperate with the first post 64(*a*), which is positioned to engage a portion of the rim 23 of the spool adjacent the post 30, to transfer rotationary force applied by the user from the retainer to the spool assembly, to allow the user to provide an initial wind up of the cord about the spool assembly prior to initial installation of the cord. It will be seen that although the posts illustrated herein extend from the end cap, they could equally well extend from the spool, with the stop member extending from the end cap.

Figure 9:
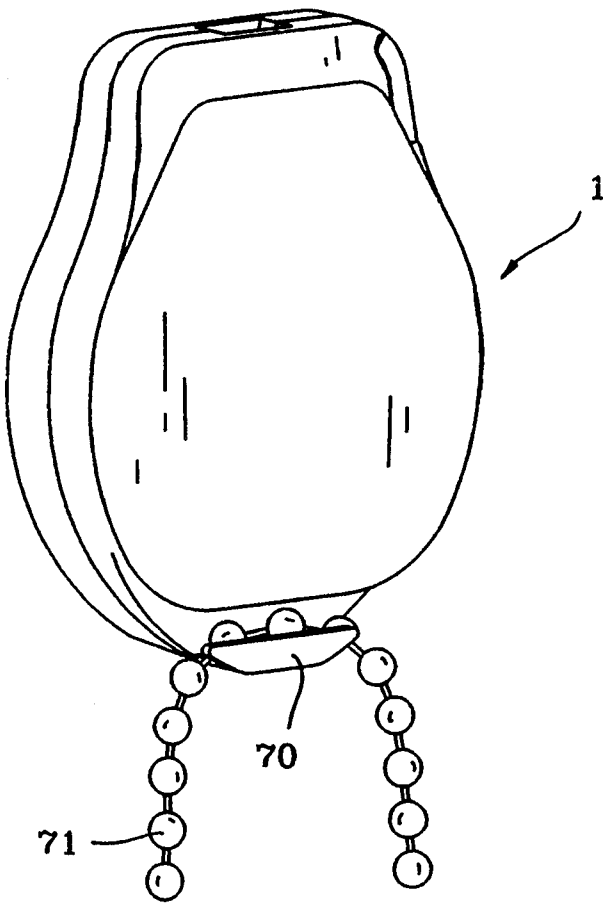
FIG. 9 is a perspective view of the device, showing the rear face thereof, with a chain loop engaged thereto.

Turning to FIG. 9, the rear face of the housing 1 is provided with a chain hanger 70, adapted to allow the user to drape surplus chain 71 thereon, for use with blinds provided with a vane-rotation chain.

Although the present invention has been described in detail by way of a preferred embodiment, it will be understood by those skilled in the art that variations may be made thereto without departing from the spirit and scope of the invention, as defined in the appended claims.

I claim:

1. A cord retraction device comprising a rotatably driven spool having cord attachment means to retain a cord to said spool, a cord receiving surface, and a retainer rotably engaged to an end of said spool and adapted to retain said cord on said cord-receiving surface, said retainer being rotatable between first and second positions, wherein in said first position the attachment means is exposed for user access thereto, and in said second position, the retainer cooperates with said spool to retain the cord on the cord receiving surface thereof.

2. A cord retraction device as claimed in claim 1 wherein said retainer is provided with an aperture therein shaped to provide said user access in said first position, and to at least partly cover said cord attachment means in said second position.

3. A cord retraction device as claimed in claim 1 wherein said first and second positions are defined by an extension member releasably engageable with a stop member, said extension member and stop member extending from said retainer and said spool.

4. A cord retraction device as claimed in claim 1 wherein said retainer is further provided with an engagement member adapted to releasably engage said spool, to selectively transfer rotationary force from said retainer to said spool to allow an initial wind up of said spool prior to installation of the cord thereon.

5. A cord retraction device as claimed in claim 1 wherein there is further provided a cord hanger thereon, for the taking up of a cord or chain dangling adjacent to said device.

6. A cord retraction device as claimed in claim 1, wherein said retainer comprises a disk, the plane of which is generally perpendicular to the longitudinal axis of the spool.

* * * * *